United States Patent [19]

Whitefoot et al.

[11] Patent Number: 4,800,624

[45] Date of Patent: Jan. 31, 1989

[54] HINGE WITH ELASTOMERICALLY SUPPORTED CHECK SPRING

[75] Inventors: Douglas E. Whitefoot, Canton, Mich.; Sumorfin Salazar, Toledo, Ohio

[73] Assignee: Ford Motor Company, Dearborn, Mich.

[21] Appl. No.: 144,626

[22] Filed: Jan. 11, 1988

Related U.S. Application Data

[63] Continuation of Ser. No. 924,187, Oct. 24, 1986, abandoned, which is a continuation of Ser. No. 736,501, May 21, 1985, abandoned.

[51] Int. Cl.[4] ..... E05D 11/10

[52] U.S. Cl. ..... 16/332; 16/335; 16/86 A

[58] Field of Search ..... 16/86 R, 86 A, 284, 16/296, 325, 332–335, 344, 347

[56] References Cited

U.S. PATENT DOCUMENTS

| | | | |
|---|---|---|---|
| 3,370,371 | 2/1968 | Marchione . | |
| 3,710,417 | 1/1973 | Berman et al. | 16/335 X |
| 3,931,664 | 1/1976 | Nakano et al. . | |
| 4,532,675 | 8/1985 | Salazar | 16/335 |

FOREIGN PATENT DOCUMENTS

| | | | |
|---|---|---|---|
| 557517 | 3/1960 | Belgium | 16/335 |
| 1186935 | 4/1970 | United Kingdom | 16/335 |

*Primary Examiner*—Fred A. Silverberg
*Attorney, Agent, or Firm*—Daniel M. Stock; Clifford L. Sadler

[57] ABSTRACT

An automotive door hinge assembly is provided with a check spring assembly consisting of a leaf spring with an elastomeric block mechanically connected in series with the leaf spring and in which the check spring assembly is carried within the door plate and body plate of the hinge assembly.

6 Claims, 2 Drawing Sheets

HINGE WITH ELASTOMERICALLY SUPPORTED CHECK SPRING

This application is a continuation of application Ser. No. 924,187, filed Oct. 24, 1986, now abandoned, which is a continuation of application Ser. No. 736,501, filed May 21, 1985, now abandoned.

BACKGROUND OF THE INVENTION

1. Field of Invention.

The present invention relates generally to automobile door hinges, and more specifically to such hinges which provide door check means integral with the hinge for holding the door in the open position.

2. Description of the Prior Art.

It is the customary practice in the automotive door hinge art to provide check spring mechanisms which function to exert a force on a portion of the hinge carrying the door to control movement to and away from a fully opened position of the door. A relevant example of the current state of the art is the hinge described in patent application Ser. No. 640,221, now U.S. Pat. No. 4,532,675, assigned to the Assignee of the present invention. In that hinge, a pair of structural members secured to the body of the vehicle and the door, respectively, are supported on a pintle axis for relative pivotal movement. One of the members carries a roller mechanism, and the other member carries a leaf spring which operates cooperatively with the roller to perform the door checking function. During movement of the door to the check position, deflection of the leaf spring by the roller is effected and design of the leaf spring to accommodate repetitive deflections has become a significant design consideration. While not an insurmountable problem, the response to this design goal in the prior art hinge was to provide a plurality of leaf members for performing the deflecting and checking function. A more optimal design in terms of cost and weight was considered to be desirable.

SUMMARY OF THE INVENTION

Responsive to this goal of optimization for design and weight in a repetitively deflecting environment, the hinge of the present invention consists of a simple, effective and economical hinge of the type in which checking function is accomplished through cooperation of a roller carried by one hinge part and a leaf spring carried by the other through the addition of a molded block of resilient material fixed on the side of the leaf spring distal the roller in close conformity with its curvilinear configuration. This design approach provides a resilient backup to the leaf spring member sufficient to permit the reduction in metallic leaf spring structure required to effect the check function.

BRIEF DESCRIPTION OF THE DRAWINGS

The structure by which this advantageous goal has been achieved in the present invention will become apprarent to those skilled in the automotive door hinge art upon reading the following description with reference being made to the accompanying drawing in which.

DESCRIPTION OF A PREFERRED EMBODIMENT

Figure 1:
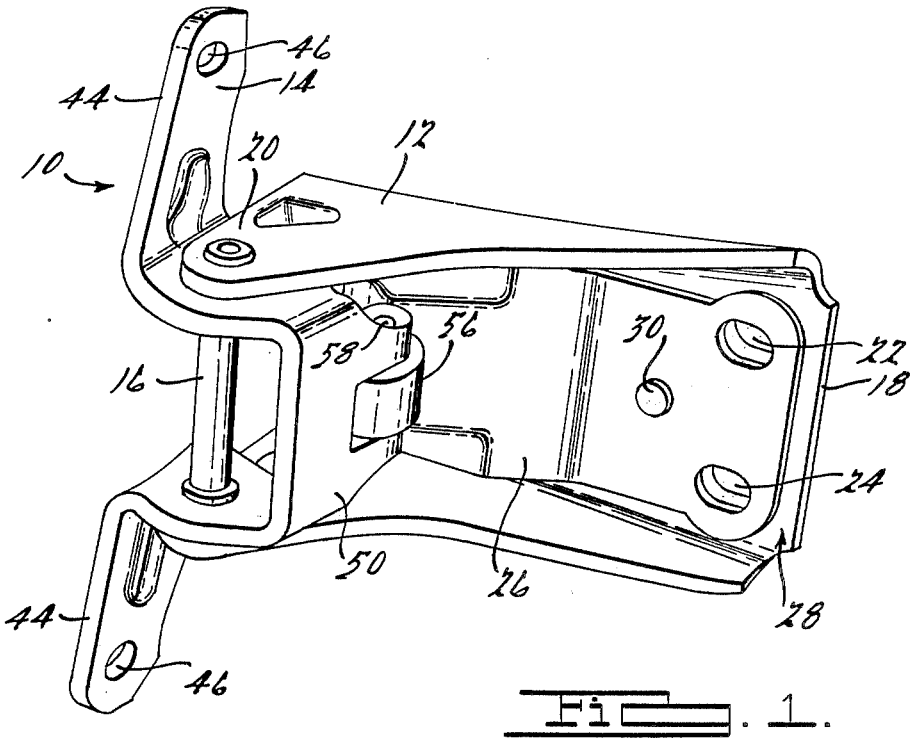
FIG. 1 is a perspective view of the hinge of the present invention in the door closed position.

Referring now to the drawings, in particular to FIG. 1 thereof, a hinge assembly 10 is illustrated as comprising generally a body plate 12 and a door plate 14 pivotally interconnected through a pintle pin 16. The body plate 12 includes a flat mounting portion 18 for abuttingly engaging a portion of a vehicle body in a conventional manner and further includes upstanding bracket portions 20 for mounting the pintle pin 16. Attachment of the mounting portion 18 to the vehicle body is preferably effected by conventional fasteners received in through holes, such as indicated at 22 and 24 in Figures 2 and 3. A check spring assembly 26 is secured to the outer face 28 of mounting portion 18 of body plate 12 via rivet 30 and the conventional fasteners.

Figure 2:
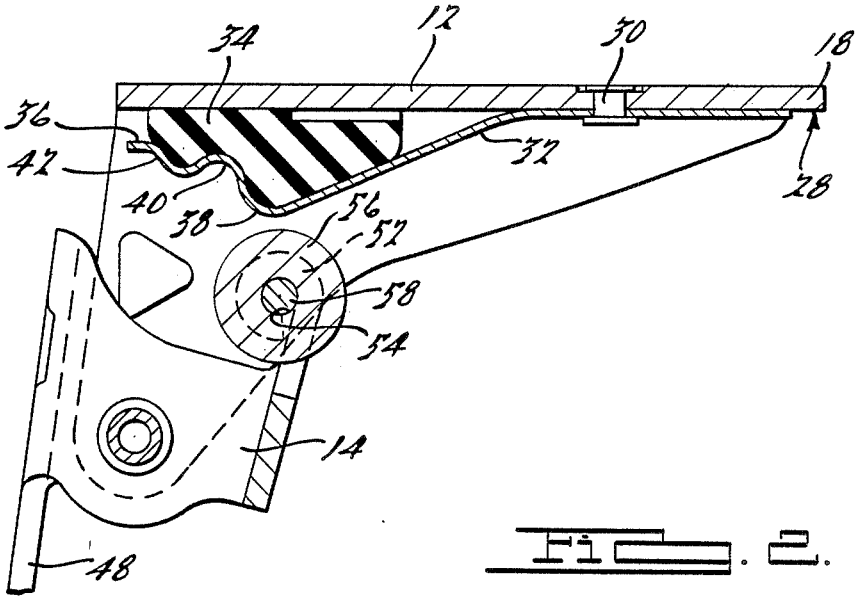
FIG. 2 is a cross-sectional view of the hinge of the present invention in the door closed position.

The check spring assembly 26 consists of a leaf spring member 32 having a curvilinear configuration, as best seen in FIG. 2, and a cushion member 34 formed as a block of resilient material, such as an exterior weatherable silicone elastomer molded to conform to the underside 36 of the leaf spring and directly abuttingly engaging the inner surface 28 of mounting portion 18 of the body plate 12. In the preferred embodiment shown, the leaf spring member 32 is formed to extend in curvilinear fashion from its points of mechanical attachment at the rivet 30 and the threaded fasteners in a direction away from the body toward the door plate 14 at the free end of the leaf spring member 32. The leaf spring member 32 is bent over as indicated at 38 to form a projection in the position closest to the door plate 14. Immediately outboard of the projection 38, a pocket 40 is formed and immediately outboard of the pocket 40, the leaf spring member 34 has a final outboard bentover portion 42.

Figure 3:
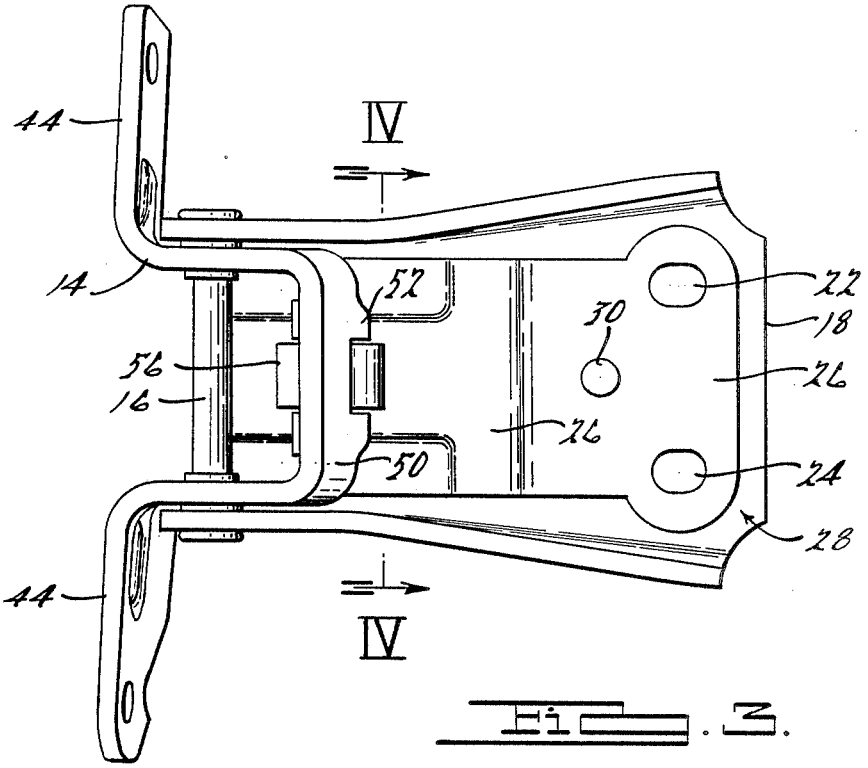
FIG. 3 is a top elevational view of the hinge of the present invention installed in the door closed position.
Figure 4:
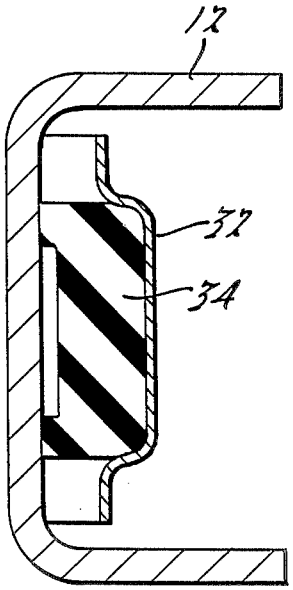
FIG. 4 is a cross-sectional view taken along line 4—4 of FIG. 3.

Turning now to the door plate 14, it is illustrated as including a pair of mounting ears 44 for receiving a pair of conventional fasteners through holes 46 for permitting conventional attachment to a portion of the door indicated at 48 in FIGS. 2 and 3. Extending normally from the ears 44 is a generally U-shaped bracket or cage portion 50 of door plate 14. This cage portion 50 is configured to receive the pintle pin 16 and includes a pair of depending and rolled over tabs 52 for defining a pair of aligned apertures 54, which rotatively support a striker consisting of a roller member 56. The roller 56 is preferably formed from reinforced nylon and is mounted on a pin 58 carried in the aperture 54 formed in the cage portion 50.

OPERATION OF THE PREFERRED EMBODIMENT

In operation, the door hinge 10 of the present invention controls pivotal movement about the axis of the pintle pin 16. As shown in FIG. 2, the roller 56 moves as the door 48 is swung open over the projection 38 into the pocket 40, and upon full opening, passes over the turned over portion 42 to move free of the check spring assembly 26. Maximum deflection of the check spring assembly 26 toward the body plate 12 occurs as the roller 56 traverses the projection 38. Moderate deflection occurs in the first check position in which the roller 56 is received in the pocket 40, whose radius of curvature is formed to abuttingly receive the roller 56. In the second check position in which the roller 56 passes over and away from the turned over portion 42, there is no deflection of the check spring assembly 26. The checking function of the hinge 10 of the present invention is thus performed in a cushioned manner owing to the resilient support of the cushion member 34 intimately joined to the underside of the leaf spring member 32 supporting it during its deflecting excursions. A series connected spring assembly is thus formed in which the cantilever loading of the leaf spring member 32 is reduced by the addition of the cushioning effect of the resilient block 34.

While only one preferred embodiment is here described, those skilled in the art will appreciate that others may be possible without departing from the scope of the invention. For example, the cushioning effect of the resilient block in combination with the leaf spring is not limited to the shape of the leaf spring member herein described. The double check configuration, including the intermediate pocket 40, may be replaced by a leaf spring having only a last turned over portion, such as that shown at 42, such as was disclosed in co-pending application, Ser. No. 640,221, now U.S. Pat. No. 4,532,675.

What is claimed is:

1. A hinge assembly for pivotally mounting a door of a motor vehicle to the vehicle body, the assembly being of the type having a body plate secured to the vehicle body, a door plate secured to the door and pivotally connected to the body plate, and check spring means mounted on one of the plates and having a portion operatively engageable in a plurality of positions with a striker member carried for movement with the other plate to hold the door plate in a door-open position, characterized in that the check spring means comprises a leaf spring member of curvilinear configuration and mounted in cantilever fashion between the door plate and the body plate for permitting cushioning deflection during certain relative movement of the plates and a cushion member fixed to the side of the leaf spring member remote from the side engageable with the striker member, the cushion member substantially conforming to the curvilinear configuration of the leaf spring member throughout a greater portion of the spring member than is engageable with the striker member and supporting the leaf spring member at all of the striker engageable positions.

2. A hinge assembly as defined in claim 1 further characterized in that the cushion member comprises a block of elastomeric material.

3. A hinge assembly as defined in claim 1 further characterized in that the cushion member comprises a block formed from an exterior weatherable silicone elastomer.

4. A hinge assembly as defined in claim 1 further characterized in that the leaf spring member has formed therein at least one pocket shaped to receive and retain the striker member in a check position corresponding to a door-open position, and the cushion member is molded in a shape adapted to directly abut the side of the leaf spring member to which it is fixed and to directly abut the adjacent face of the other plate.

5. A hinge assembly for pivotally mounting a door of a motor vehicle to the vehicle body, the assembly being the type having a body plate secured to the vehicle body, a door plate secured to the vehicle door and pivotally connected to the body plate, and check spring means for controlling relative movement between the door and the body mounted on the body plate and operatively engageable with that striker member comprising a roller carried for movement with the door plate to hold the vehicle door in a door-open position, characterized in that the check spring means comprises a leaf spring member of curvilinear configuration having at least one pocket formed therein for receiving the roller member and defining a check position for holding the door in door-open position, the leaf spring member being fixedly mounted at one end to the body plate and being deflectable away from the door plate toward the body plate in response to engagement in a plurality of positions with the roller member with a portion of length of the leaf spring member, and a cushion member intimately abutting the side of the leaf spring member in substantial conformance with the curvilinear configuration of the side of the leaf spring member throughout the portion of the length of the leaf spring member in excess of that with which the roller member is engaged and supporting the leaf spring member at all of the striker engageable positions and in juxtaposition with the body plate and bonded thereto and abuttingly engaging the juxtaposed surface of the body plate.

6. A hinge assembly as defined in claim 5 and further characterized in that the cushion member is formed as a resilient block from an exterior weatherable silicone elastomer.

* * * * *